US008302422B2

(12) United States Patent
Snider et al.

(10) Patent No.: US 8,302,422 B2
(45) Date of Patent: Nov. 6, 2012

(54) REFRIGERATOR WITH TREATED WATER SYSTEM

(75) Inventors: Bryan Snider, Louisville, KY (US); Cory Tafoya, Louisville, KY (US)

(73) Assignee: General Electric Company, Schenectady, NY (US)

( * ) Notice: Subject to any disclaimer, the term of this patent is extended or adjusted under 35 U.S.C. 154(b) by 566 days.

(21) Appl. No.: 12/574,770

(22) Filed: Oct. 7, 2009

(65) Prior Publication Data

US 2011/0079037 A1 Apr. 7, 2011

(51) Int. Cl.

| | |
|---|---|
| ***F25D 3/02*** | (2006.01) |
| ***F25D 17/04*** | (2006.01) |
| ***B01D 35/30*** | (2006.01) |
| ***B01D 35/153*** | (2006.01) |

(52) U.S. Cl. ..... 62/318; 62/317; 210/232; 210/234

(58) Field of Classification Search ..... 62/317, 62/318; 210/232, 234, 235

See application file for complete search history.

(56) References Cited

U.S. PATENT DOCUMENTS

| | | | | |
|---|---|---|---|---|
| 7,056,435 | B2 * | 6/2006 | Jenkins et al. | 210/232 |
| 2004/0211717 | A1 * | 10/2004 | Mitchell et al. | 210/235 |
| 2006/0254971 | A1 * | 11/2006 | Tubby et al. | 210/235 |
| 2008/0141697 | A1 * | 6/2008 | Coleman | 62/318 |

FOREIGN PATENT DOCUMENTS

KR 10-0817004 * 3/2008

* cited by examiner

*Primary Examiner* — Judy Swann
*Assistant Examiner* — Corey Hawse
(74) *Attorney, Agent, or Firm* — Fay Sharpe LLP

(57) ABSTRACT

The present disclosure provides a refrigerator having a cabinet including at least one access area having an open face and a grill door for selectively closing the open face of the access area. The refrigerator can also include a water using accessory provided on the cabinet. The grill door can be selectively retained to the cabinet wherein a manifold is fixed relative to the grill door and fluidly couples the water using accessory to a water supply. A water treatment cartridge can be removably coupled to a casing such that when the cartridge is coupled to the manifold, the cartridge treats the water from the water supply for use by the water using accessory. The manifold can be located on the grill door such that the mounting of the cartridge to the manifold moves the cartridge from within the access area to outside of the access area as the grill door moves from a closed position to an opened position, respectively.

11 Claims, 4 Drawing Sheets

REFRIGERATOR WITH TREATED WATER SYSTEM

BACKGROUND

The present disclosure relates to a water filter cartridge and manifold for filtering water in conjunction with a refrigerator/freezer appliance. More particularly, the present disclosure relates to providing more usable space within a fresh food compartment and easier access to the water filter cartridge through placement of the water filter cartridge and manifold.

Traditionally, a water filter and the associated cartridge are placed in a fresh food compartment. This results in taking away usable storage space from the fresh food compartment. It is to be appreciated, that any space consumed by the water filter and manifold, and/or any other component, ultimately results in less usable storage space to the consumer. Thus, the problem addressed with the present disclosure is eliminating the water filter and manifold from the fresh food compartment in order to provide the consumer with more usable, and albeit valuable, storage space. Moving these components also gives the fresh food compartment a more pleasing appearance. In addition, the present disclosure provides for a more convenient position for access to the water filter that enables the operator to change the water filter cartridge easily and efficiently.

SUMMARY

In one aspect of the present disclosure, a refrigerator is provided comprising a cabinet including at least one access area having an open face and a grill door for selectively closing the open face of the access area. The refrigerator can also include a water using accessory provided on the cabinet. The grill door can be selectively retained to the cabinet wherein a manifold is fixed relative to the grill door and fluidly couples the water using accessory to a water supply. A water treatment cartridge can be removably coupled to a casing such that when the cartridge is coupled to the manifold, the cartridge treats the water from the supply for use by the water using accessory. The manifold can include a casing defining a hollow interior sized to receive the cartridge for removably mounting the cartridge to the casing. The manifold can be located on the grill door such that the mounting of the cartridge to the manifold moves the cartridge from within the access area to outside of the access area as the grill door moves from a closed position to an opened position, respectively.

In another aspect of the present disclosure, a refrigerator is provided comprising a cabinet defining at least one access area having an open face and a grill door for selectively closing the open face of the access area. The refrigerator further comprises a water using accessory. Additionally, the refrigerator includes a manifold mounted relative to the cabinet which fluidly couples the water using accessory to a water supply. A water treatment cartridge is provided which is removably coupled to the manifold such that when the cartridge is coupled to the manifold the cartridge treats the water from the water supply for use by the water using accessory. The manifold can be located on the grill door such that the mounting of the cartridge to the manifold moves the cartridge from within the access area to outside of the access area as the grill door moves from a closed position to an opened position, respectively. The grill door includes a retention mechanism for retaining the grill door in the closed position. Additionally, the fluid coupling includes tubing having at least a portion comprising flexible tubing.

In still another aspect of the present disclosure, a method for changing a water treatment cartridge is provided comprising a cabinet for a refrigerator including at least one access area having an open face and a grill door for selectively closing the open face of the access area wherein the grill door includes a retention mechanism for retaining the grill door in a closed position. The grill door includes a manifold fixed relative to the grill door which fluidly couples a water using accessory to a water supply. The method further comprises moving the grill door into the opened position; removing the water treatment cartridge from the manifold outside of the access area; exchanging a used water filter cartridge with an unused water filter cartridge; and, closing the grill door in order to close the opened face of the access area.

DETAILED DESCRIPTION

Figure 1:
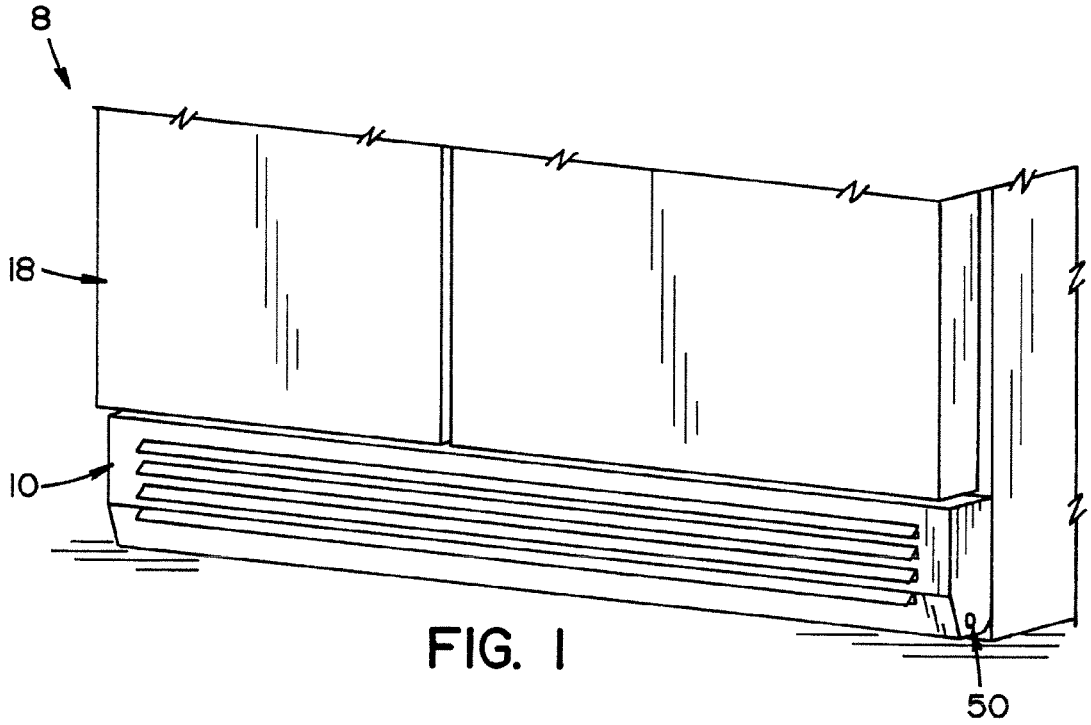
FIG. 1 is a perspective view of the lower portion of a refrigerator with a filter cartridge mounted on an inside surface of a front grill of a refrigerator while the grill is retained in a closed position.

This disclosure provides for a refrigerator/freezer appliance 8 including a grill panel or grill door 10 that retains a water filter cartridge 12 and a manifold or housing 14 thereon. In particular, the grill 10, can be positioned below and outside of a fresh food and/or a freezer compartment or door 18, and can be connected (i.e. hingedly) to the appliance 8 in order to provide access thereunder. The grill 10 can be hingedly connected and selectively opened such that it allows the user easy access to the water filter 12 and manifold 14 retained on an inner surface 22 of the grill 10. It is to be appreciated that the water filter 12 and manifold 14 can be hidden when the grill 10 is closed. The grill 10 provides the user closer and easier access to the filter 12 which provides for a more efficient and cleaner filter change when desired. It is to be appreciated that the user does not have to open the fresh food compartment (not shown) or freezer compartment 18 in order to change the filter 12. Relocating the water filter cartridge 12 and manifold 14 from out of the fresh food compartment provides additional storage space therein.

Moving the manifold 14 and filter 12 onto the hingedly retained grill panel 10 allows the user ease of exchange of the filter cartridge 12. This encourages the customer to change the filter 12 readily at the recommended intervals. The location of the water filter cartridge 12 and manifold 14 also requires less tubing 28 between a water using accessory 30 and the manifold 14. A water supply line 29 connects a water supply to the manifold 14. Additionally, the tubing 28, 29 can include at least a portion of flexible tubing 24, 25, respectively, for connecting the manifold 14 to the water using accessory 30 and water supply to accommodate the grill panel 10 and manifold 14 hingedly moving from the closed position (FIG. 1) to the opened access position (FIGS. 2 and 3). The flexible tubing 24, 25 allows the manifold 14 to accommodate the increase in distance as the manifold 14 and filter cartridge 12 move away from the cabinet 9 when the grill 10 is opened.

The cartridge 12 and manifold 14 supply treated water from a source (not shown), via water line 29, to the one or more water-using accessories 30 of the appliance 8, such as a chilled water dispenser and an ice maker, through water lines 26, 27, 28.

Figure 2:
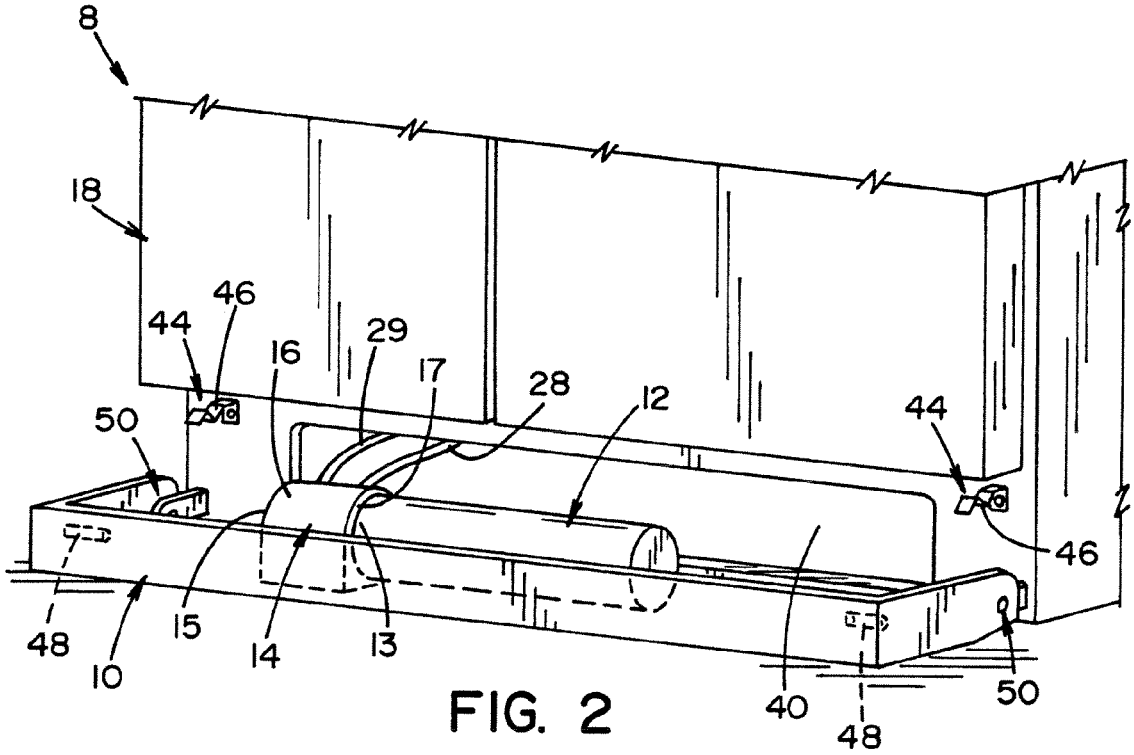
FIG. 2 is a perspective view of the lower portion of the refrigerator of FIG. 1 with the grill in an opened position.
Figure 3:
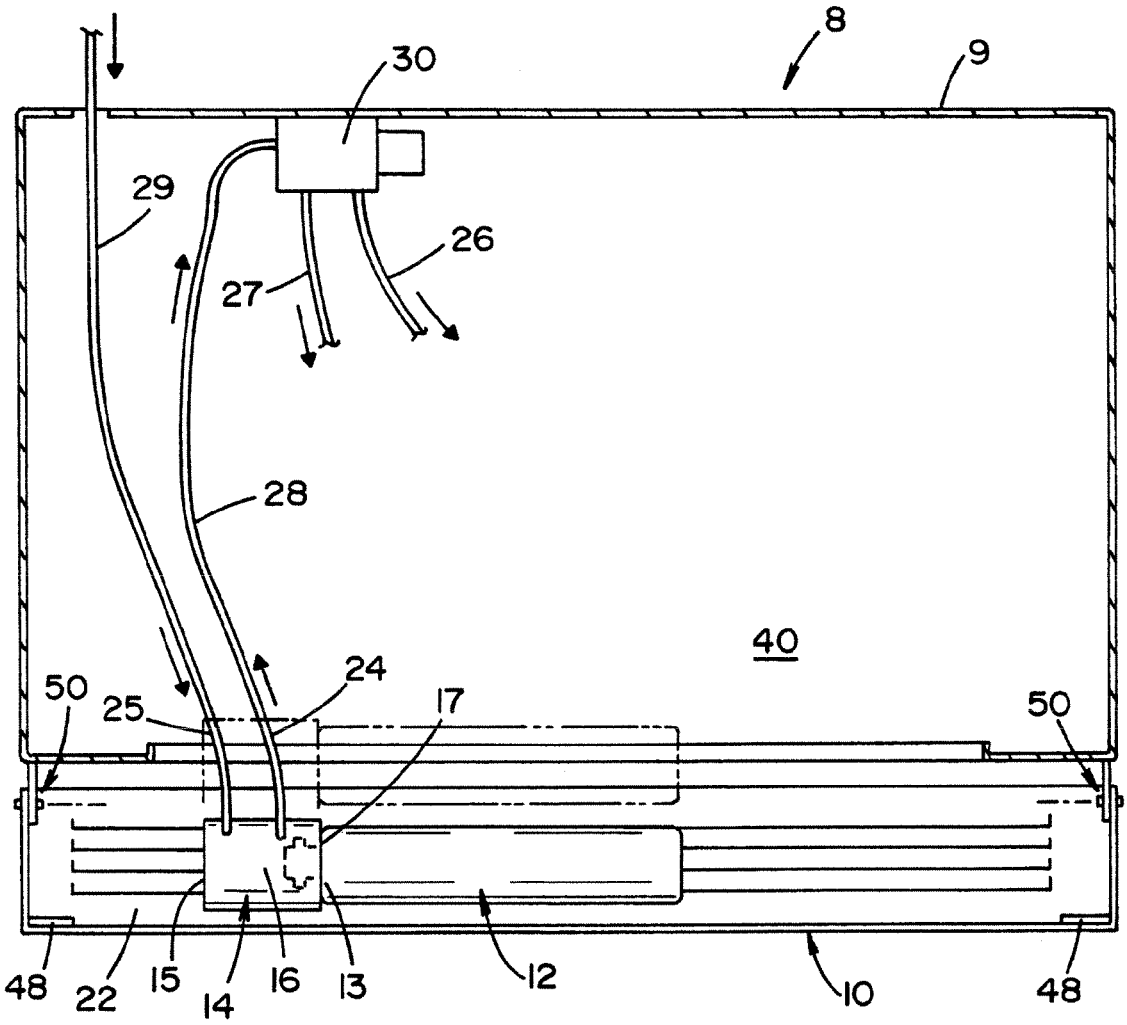
FIG. 3 is a water flow diagram displaying the flow of water through the appliance of FIG. 1; and, FIG. 4 is an enlarged perspective view of the water filter cartridge and manifold.
Figure 4:
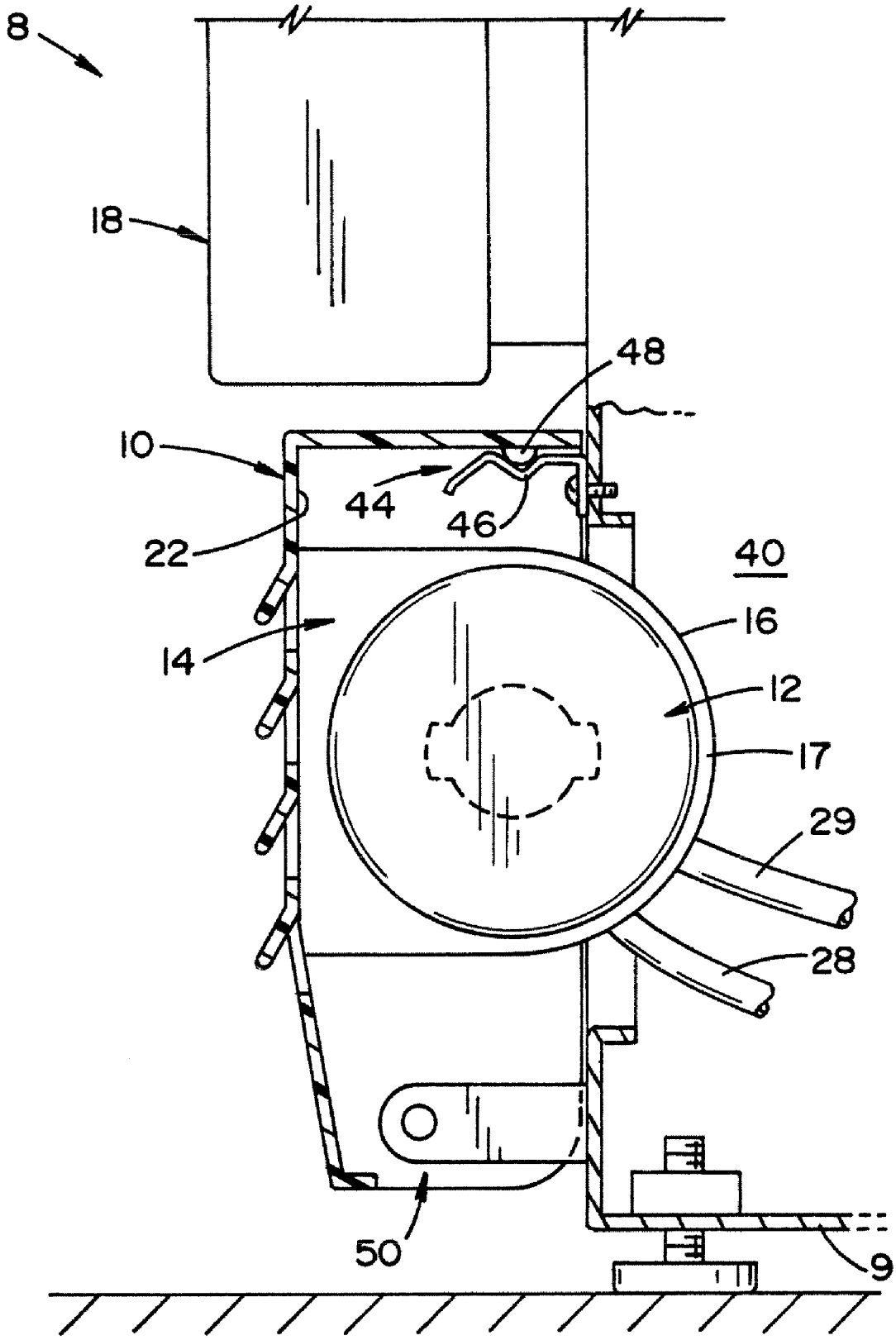
Figure 5:
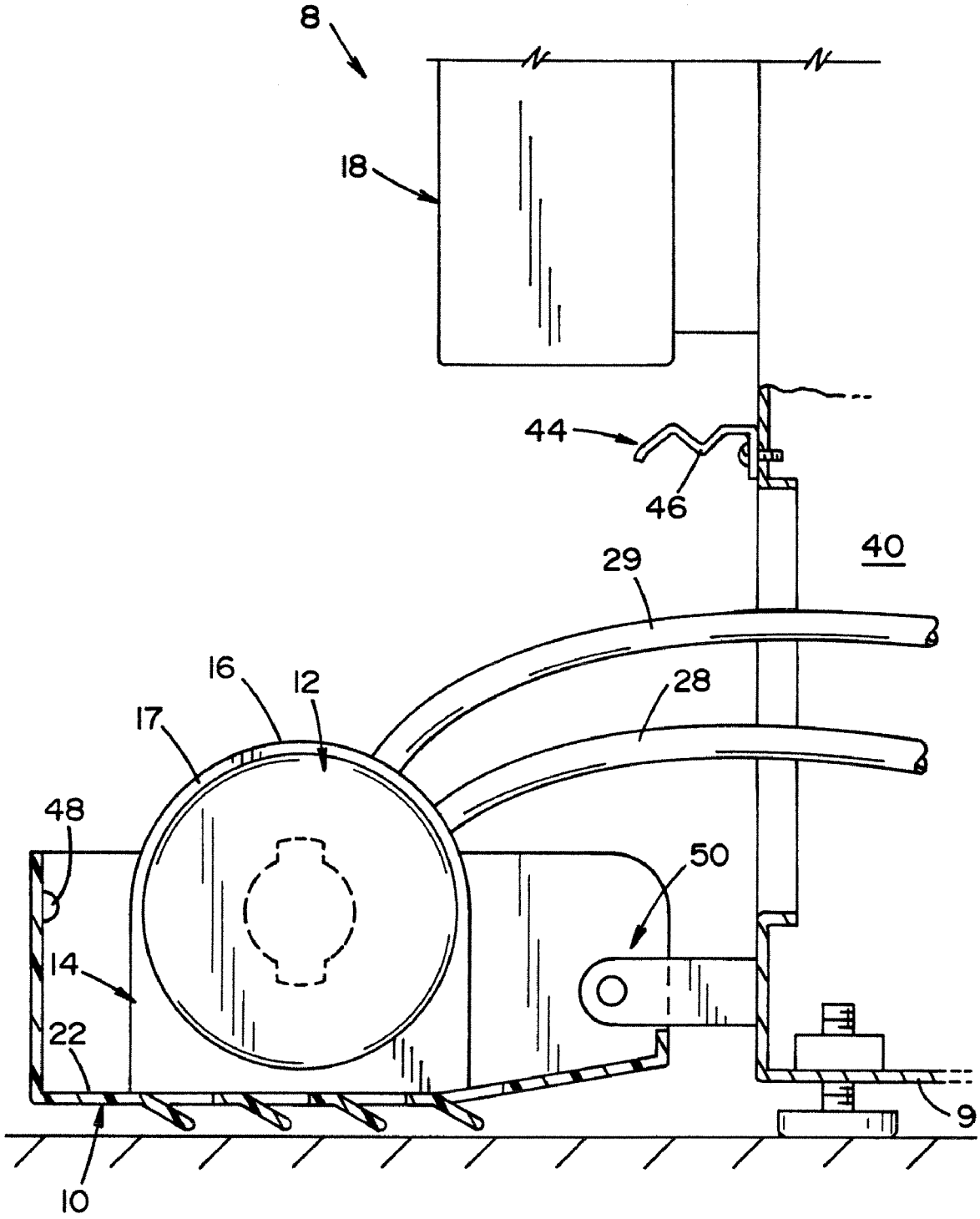
FIG. 5 is an enlarged view of the water filter cartridge and manifold rotated to an access position.

Referring to FIGS. 1-3, the appliance environment of a refrigerator appliance 8 incorporating the cartridge 12 and manifold or housing 14 will be described in greater detail. The refrigerator 8 comprises a cabinet 9 that can be divided into a freezer compartment and a refrigerated compartment, and which can include hingedly mounted doors which close the compartments (not shown). The cabinet 9 can include the grill panel 10 that covers an access area or lower compartment 40 formed in the cabinet. The grill 10 can be hingedly rotatable to permit access to the access area 40, the filter cartridge 12, and the housing 14 (FIG. 5). The grill 10 can include a retention mechanism 44 for retaining the grill 10 in the closed position (FIG 4). In one exemplary arrangement, it is to be appreciated that the retention mechanism 44 can include magnets or spring clips 46 that secure into an indent, or detent 48, on the grill 10. The retention mechanism 44 provides the securing means while the grill 10 is in a closed position so that the grill panel 10 does not pop open whenever it is accidentally bumped. The access area 40 can house various components of the refrigeration system. The cartridge 12 and manifold 14 are mounted on the inside wall or inner surface 22 of the grill 10 and is contained within the access area 40 to minimize any reduction of volume to either the freezer or refrigerated compartments.

Referring to FIGS. 2-4, the mounting of the cartridge 12 to the refrigerator grill 10 includes the filter manifold 14 permanently mounted to the inside wall 22 of the grill 10. The manifold 14 can include a cylindrical casing 16 for receiving one end 13 of the filter cartridge 12. FIGS. 2-4 show the filter cartridge 20 mounted within the casing 16. The manifold 14 comprises an inlet port for coupling to the water supply line 29 and an outlet port for coupling to the water-using accessory 30 via water line 28. The cartridge 12 comprises inlet and outlet fittings that couple with the inlet and outlet ports, respectively, when the cartridge 12 is in the inserted position to establish water flow from the water supply line 29, through the cartridge 12, and to the water-using accessory 30. Although not shown, the manifold can further comprise a valve for each of the inlet and outlet ports, with each valve having a follower, and wherein each of the inlet and outlet fittings can have a cam that contacts the followers to open the valves when the cartridge is in the inserted or mounted position.

The casing 16 can have a first end 15 and a second end 17. The casing 16 comprises a minority of the length of the cartridge 12, and the inner diameter of the casing 16 is approximately the same as the outer diameter of the cartridge 12.

The grill 10 and cabinet 9 can include a pivoting fixture, pin, or hinge mechanism 50 connecting the grill 12 to the cabinet 9. When the grill 10 is pivoted to an opened position (FIGS. 2 and 3), the filter 12 rotates from inside the access area 40 to outside the access area 40. Once the filter 12 is outside the access area 40, it allows the user easy access to the water filter 12 retained on the inner surface 22 of the grill 10 without having to peer into or bend down to view into the access area 40.

The location of the water filter cartridge 12 in relation to the grill 10 provides a method for changing of the water filter 12 such that the changing activity is conducted outside of the access area 40. In particular, when the grill 10 is in the open position, the filter 12 is readily accessible in a position outside of the access area 40. In connection therewith, changing of the water filter 12 typically results in some escape of water during the disconnecting of the old filter and/or the connecting of a new filter into the cylindrical casing of the manifold 14. It is to be appreciated that the resultant escape of water will occur outside of the access area 40 where easy cleanup results. In contrast, other manifolds and the changing of the water filter cartridge are done within the access area and/or within the refrigerator compartments. Thus, prior art configurations result in the escape of water into undesirable areas. In particular, any escape of water in the access area 40 results in a cumbersome cleanup. Any water that has escaped and it not subsequently cleaned up can result in mold growth or other undesirable affects of having water/moisture retained in, and under, the access area 40.

The invention has been described with reference to certain embodiments. Obviously, modifications and alterations will occur to others upon reading and understanding the preceding detailed description. It is intended that the invention be construed as including all such modifications and alterations.

What is claimed is:

1. A refrigerator comprising:

a cabinet comprising at least one access area having an open face and a grill door for selectively closing the open face of the access area;

a water-using accessory provided on the cabinet;

the grill door selectively retained to the cabinet;

a manifold fixed relative to the grill door and fluidly coupling the water-using accessory to a water supply;

a water-treatment cartridge removably coupled to the manifold such that when the cartridge is coupled to the manifold, the cartridge treats the water from the water supply for use by the water-using accessory; and, the manifold comprises a casing defining a hollow interior sized to receive the cartridge for removably mounting the cartridge to the casing, wherein the manifold being located on the grill door such that the mounting of the cartridge to the manifold moves the cartridge from within the access area to outside of the access area as the grill door moves from a closed position to an opened position, respectively.

2. The refrigerator according to claim 1, wherein the cartridge is accessible from outside of the cabinet when the grill door is in the opened position.

3. The refrigerator according to claim 2, wherein the grill door is located at a lower front portion of the cabinet.

4. The refrigerator according to claim 1, wherein the manifold comprises an inlet port for coupling to the water supply and an outlet port for coupling to the water-using accessory, and the cartridge comprises inlet and outlet fittings that couple with the inlet and outlet ports, respectively, when the cartridge is in the inserted position to establish water flow from the water supply, through the cartridge, and to the water-using accessory.

5. The refrigerator according to claim 4, wherein the manifold further comprises a valve for each of the inlet and outlet ports, with each valve having a follower, and each of the inlet and outlet fittings have a cam that contacts the followers to open the valves when the cartridge is in the inserted position.

6. A refrigerator comprising:

a cabinet defining at least one access area having an open face and a grill door for selectively closing the open face of the access area;

a water-using accessory;

a manifold mounted relative to the cabinet and fluidly coupling the water-using accessory to a water supply;

a water-treatment cartridge removably coupled to the manifold such that when the cartridge is coupled to the manifold, the cartridge treats the water from the water supply for use by the water-using accessory wherein the fluid coupling includes tubing having at least a portion comprising flexible tubing;

the manifold being located on the grill door such that the mounting of the cartridge to the manifold moves the cartridge from within the access area to outside of the access area as the grill door moves from a closed position to an opened position, respectively; and, the grill door includes a retention mechanism for retaining the grill door in the closed position.

7. The refrigerator according to claim 6, wherein the filter is accessible from outside of the cabinet when the grill door is in the opened position.

8. The refrigerator according to claim 7, wherein the grill door is located at a lower front portion of the cabinet.

9. The refrigerator according to claim 8, wherein the manifold comprises an inlet port for coupling to the water supply and an outlet port for coupling to the water-using accessory, and the cartridge comprises inlet and outlet fittings that couple with the inlet and outlet ports, respectively, when the cartridge is in the inserted position to establish water flow from the water supply, through the cartridge, and to the water-using accessory.

10. The refrigerator according to claim 9, wherein the manifold further comprises a valve for each of the inlet and outlet ports, with each valve having a follower, and each of the inlet and outlet fittings have a cam that contacts the followers to open the valves when the cartridge is in the inserted position.

11. The refrigerator according to claim 10, wherein the manifold further comprises inlet and outlet passageways fluidly connected to the inlet and outlet ports, with the valves being mounted in the passageways such that the followers extend into the ports.

* * * * *